United States Patent [19]

Modena et al.

[11] 4,152,555

[45] May 1, 1979

[54] ARTIFICIAL EAR FOR TELEPHONOMETRIC MEASUREMENTS

[75] Inventors: Giulio Modena, Caselle; Aldo Reolon, Chieri-Torino, both of Italy

[73] Assignee: CSELT - Centro Studi e Laboratori Telecomunicazioni S.p.A., Turin, Italy

[21] Appl. No.: 884,641

[22] Filed: Mar. 8, 1978

[30] Foreign Application Priority Data

Mar. 9, 1977 [IT] Italy ..... 67507 A/77

[51] Int. Cl.[2] ..... H04R 29/00

[52] U.S. Cl. ..... 179/175.1 A

[58] Field of Search ..... 179/175.1 A, 1 C, 2 C, 179/6 AC, 107 R, 107 E; 73/1 DV, 4 R; 340/5 C

[56] References Cited

U.S. PATENT DOCUMENTS 3,744,294 7/1973 Lewis et al. ..... 179/175.1 A

OTHER PUBLICATIONS

Green Book, vol. V, Recommendation p. 51, ". . . Artifical Ear . . . ", recommedation by CCITT of the IEC.

Funk-Technik, 32, Jahrgang, Nr. 5/1977, "A New Coupling Device for Headphone . . . Measurement".

*Primary Examiner*—Thomas A. Robinson

*Attorney, Agent, or Firm*—Karl F. Ross

[57] ABSTRACT

A device to be used in phonometric measurements on telephone equipment, simulating a human ear, has a generally disk-shaped body with an annular ridge encompassing a frustoconical central recess serving as a wide-open entrance cavity. The body has several internal cavities communicating with the recess through restricted channels, namely a pair of major cavities resonant at low audio frequencies, an intermediate cavity resonant in the middle audio range, and a minor cavity resonant at high audio frequencies, the last-mentioned cavity having the shape of a narrow cylinder extending generally along the body axis. A microphone, connected to a measuring circuit, rises from the bottom of the recess to substantially the top level of the surrounding ridge to pick up incoming sounds at that level.

10 Claims, 6 Drawing Figures

ARTIFICIAL EAR FOR TELEPHONOMETRIC MEASUREMENTS

FIELD OF THE INVENTION

Our present invention relates to a device, referred to hereinafter as an artificial ear, facilitating phonometric measurements on telephone equipment.

BACKGROUND OF THE INVENTION

So-called telephonometric measurements, designed to test the performance of electroacoustic transducers such as the receivers and transmitters of telephone handsets, are advantageously carried out automatically with the aid of devices simulating human ears and mouths. This not only saves manpower but also allows the standardization of testing equipment according to internationally established specifications.

Thus, an artificial ear of the type here envisaged is a phonometric device which acts as an acoustic load for a telephone receiver and whose sensitivity/frequency characteristic should correspond as closely as possible to that of the human ear. A microphone forming part of the device translates the incoming sound waves into electrical signals which are sent to a measuring circuit for evaluation of the response characteristic of the receiver undergoing testing.

The International Electrotechnical Commissioner (IEC) has proposed an artificial ear whose adoption for telephonometric measurements was provisionally recommended by the CCITT during its 5th Plenary Assembly (see Green Book, Vol. V, recommendation P51).

The IEC artificial ear simulates the performance of a human ear whose auricle or pinna is tightly pressed against the earpiece of a telephone handset so that no acoustic leakages occur between the telephone receiver and the ear. In practice, however, a user will press the receiver tightly against his ear only under extraordinary circumstances, as where the signal is very faint or the telephone is located in a noisy room. Normally, the handset is held close to the ear but with enough clearance to generate significant acoustic leakage.

Thus, a telephone receiver tested with the IEC artificial ear and found to have a substantially frequency-independent response may not perform satisfactorily in actual use.

OBJECT OF THE INVENTION

The object of our present invention, therefore, is to provide an improved phonometric device for the purpose set forth which more faithfully reproduces the conditions of sound reception by a human ear held close to a telephone receiver.

SUMMARY OF THE INVENTION

A phonometric device according to our invention comprises a generally disk-shaped body with an annular ridge encompassing a substantially frustoconical, outwardly diverging recess which may be termed an entrance cavity for sound waves emanating from a telephone receiver placed on that ridge, the sound waves being converted into electrical signals by a microphone disposed in the recess. The body is provided with several internal cavities communicating with the recess, namely one or preferably two major cavities resonant at a low audio frequency, an intermediate cavity resonant in the middle audio range, and a minor cavity resonant at a high audio frequency. The minor cavity is elongate, preferably cylindrical, and opens onto the recess near the bottom thereof.

According to a more particular feature of our invention, the major and intermediate cavities communicate with the recess through restricted channels which are of acoustically resistive and inductive character while the cavities themselves are essentially capacitive. The minor cavity, which preferably extends substantially along the axis of the body and its frustoconical recess, acts as an acoustical transmission line with distributed constants.

Pursuant to a further feature of our invention, both the intermediate and minor cavities are separated from the recess or entrance cavity by substantially pure acoustic resistances.

The depth of the recess, generally on the order of 1 cm, corresponds to about one acoustic wavelength at a frequency between 3 and 4 Khz. In order to minimize the effect of the resulting phase delay, we prefer to dispose the pick-up head of the microphone substantially at the level of the crest of the ridge, i.e. at the broad base of the frustoconical recess, in the immediate vicinity of the receiver to be tested.

BRIEF DESCRIPTION OF THE DRAWING

The above and other features of our invention will now be described in detail with reference to the accompanying drawing in which.

SPECIFIC DESCRIPTION

Figure 1:
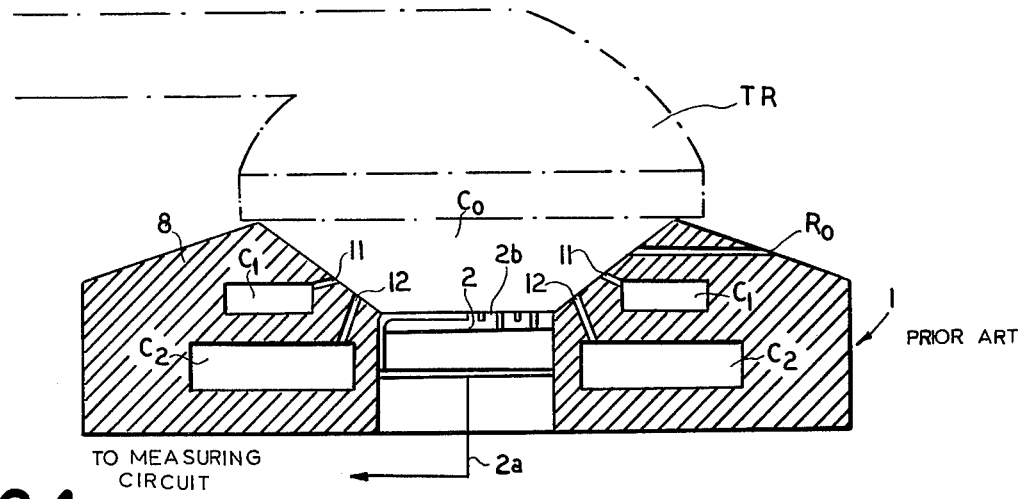
FIG. 1 is an axial sectional view of an artificial ear of the type proposed by IEC.

In FIG. 1 we have shown a conventional artificial ear with a generally toroidal body 1 having an annular ridge 8 which defines an upwardly diverging frustoconical recess or entrance cavity $C_0$. The body has two internal annular cavities $C_1$ and $C_2$ communicating with cavity $C_0$ through respective channels or channel groups 11, 12 of acoustically resistive/inductive character in which the air volume behaves as a column. Centrally within body 1, at the bottom of cavity $C_0$, there is disposed a microphone 2 with an output lead 2*a*, connected to a nonillustrated measuring circuit, and a pick-up head 2*b* lying at the level of the minor base of the frustoconical recess. The dimensions of this body and its cavities conform to the specifications given in the aforementioned CCITT recommendation.

Upon the emplacement of a telephone receiver TR on ridge 8, as indicated in phantom lines, cavity $C_0$ communicates with the external atmosphere through a passage $R_0$ serving to equalize the static pressure between the cavity and the ambient air.

Figure 2:
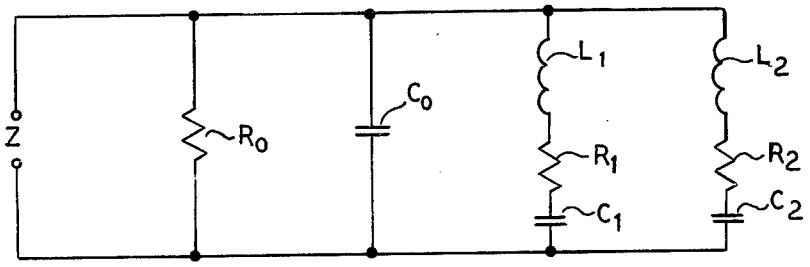
FIG. 2 is an equivalent-circuit diagram for the conventional artificial ear shown in FIG. 1.
Figure 3:
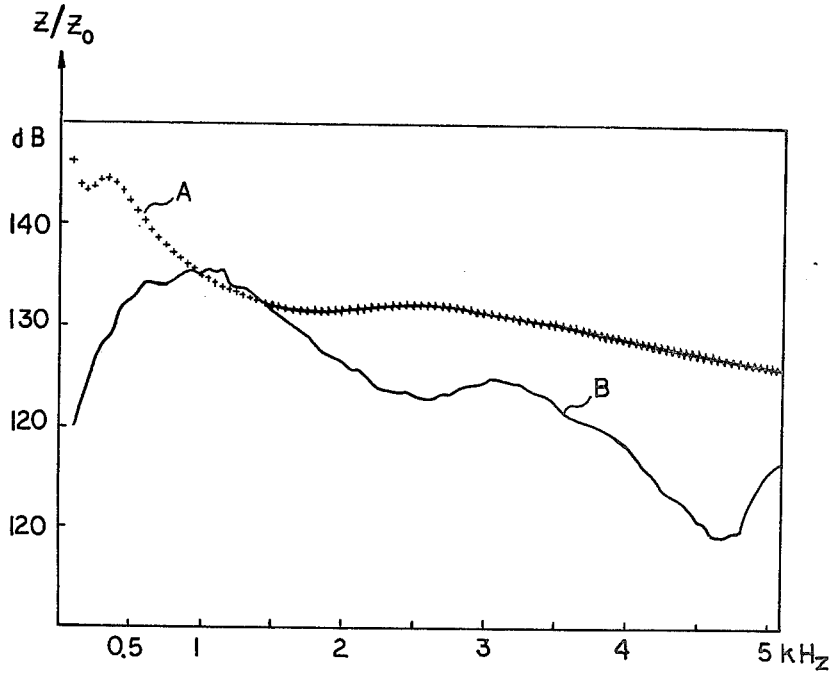
FIG. 3 is a comparative graph.

The equivalent-circuit diagram of FIG. 2 is a two-terminal filter network with four parallel branches composed of electrical impedances which have been given the same reference characters as the corresponding acoustic impedances of FIG. 1. One of these branches is a pure resistance $R_0$ equivalent to the acoustic resistance of the correspondingly designated passage in FIG. 1. Another branch is a capacitance $C_0$ representing the entrance cavity of device 1. A third branch consists of a capacitance $C_1$, corresponding to the upper internal cavity of FIG. 1, in series with a resistance $R_1$ and an inductance $L_1$ which are the acoustic parameters of its restricted channel (or channels) 11. The fourth branch, analogously, consists of a capacitance $C_2$ (representing the lower internal cavity of FIG. 1) in series with a resistance $R_2$ and an inductance $L_2$ which are the acoustic parameters of its connecting channel or channels 12. This network has an impedance Z measured between its terminals and plotted in FIG. 3 against frequency within the audio range, as shown by a curve A. The impedance is given in $dB=20 \log Z/Z_0$, the reference impedance being the one measured for an acoustic impedance of 1 Mks acoustical ohm $=1 N \cdot sec/m^5$.

As explained above, curve A of FIG. 3 constitutes an idealized audiometric characteristic substantially conforming to the acoustic impedance of a human ear pressed tightly against a telephone receiver. We have found, however, that a practical telephonometric characteristic—allowing for acoustic leakages between the receiver and the auricle—should have a shape as shown by curve B in FIG. 3. This is accomplished with the aid of the improved artificial ear shown in FIG. 4.

The device according to our invention comprises a generally disk-shaped body 10 which is outwardly similar to body 1 of FIG. 1 and has an annular ridge 80 defining a frustoconical recess or entrance cavity $C_0'$. The generatrices of this recess are steeper than in the device of FIG. 1, including with the axis an angle of roughly 30° compared with roughly 60° in the IEC structure. A microphone 20, with an output lead 20*a* connectable to a nonillustrated measuring circuit, has a pick-up head 20*b* located substantially at the level of the crest of ridge 80. Cavity $C_0'$ again communicates with the external atmosphere through a substantially radial channel $R_0'$ representing a more or less pure acoustic resistance.

In lieu of the two annular cavities $C_1$ and $C_2$ shown in FIG. 1, body 10 is provided with a set of four generally cylindrical or ring-segmental internal cavities $C_3$, $C_4$, $C_5$ and $C_6$ of progressively diminishing volume resonant at different frequencies within the audio range. Major cavity $C_3$, communicating with recess $C_0'$ through a restricted channel 30, is essentially an acoustic capacitance of not less than about 12 $\mu$F and preferably not more than about 15 $\mu$F. Major cavity $C_4$ is also essentially an acoustic capacitance of not less than about 9 $\mu$F and preferably not more than about 12 $\mu$F. Intermediate cavity $C_5$ is a capacitance of not less than about 0.5 $\mu$F and preferably not more than about 0.6 $\mu$F. Minor cavity $C_6$ has a volume which is less than that of cavity $C_4$ by about one order of magnitude.

Cavity $C_4$ communicates with cavity $C_0'$ through a restricted channel 40 generally similar to channel 30. Cavity $C_5$ also terminates in a reduced channel 50 which, like channels 30 and 40, has a mixed resistive/inductive acoustic characteristic. Between channel 50 and recess $C_0'$ there is provided a substantially pure acoustic resistance in the form of an aperture 51 in an overlying disk 70. A similar acoustic resistance 61 separates this recess from the elongate cavity $C_6$ which is cylindrical and extends substantially along the axis of the recess and of body 10.

For calibration purposes, threaded plugs 52 and 62 are adjustably screwed into the bottom ends of cavities $C_5$ and $C_6$.

Figure 4:
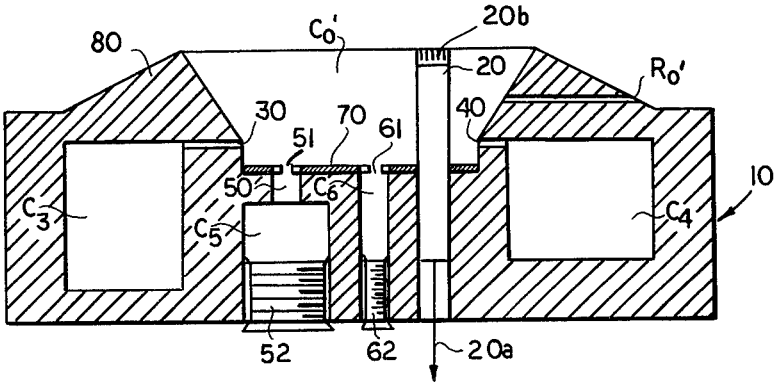
FIG. 4 is a view similar to FIG. 1 but showing an improved artificial ear according to our invention.
Figure 5:
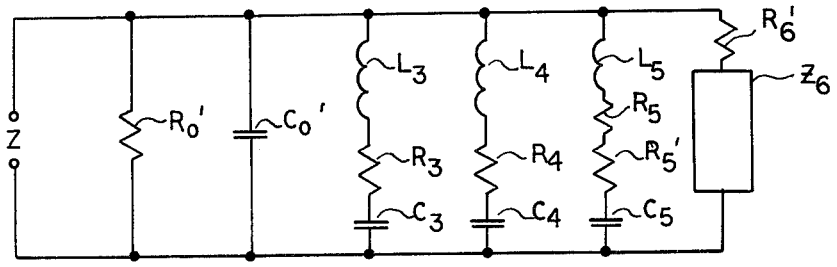
FIG. 5 is an equivalent-circuit diagram relating to the device of FIG. 4.
Figure 6:
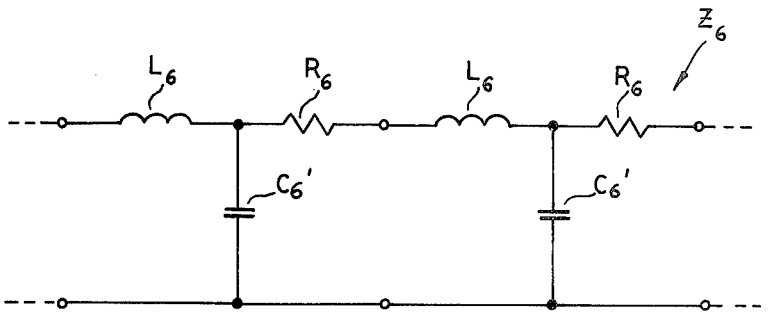
FIG. 6 is a more detailed diagram of a component of the circuit of FIG. 5.

The equivalent-circuit diagram of FIG. 5 is a network with six parallel branches, including a resistive branch $R_0'$ and a capacitive branch $C_0'$ representing the correspondingly designated channel and cavity of FIG. 4. A further branch consists of a capacitance $C_3$, corresponding to the first major cavity of FIG. 4, in series with a resistance $R_3$ and an inductance $L_3$ representing the acoustic parameters of channel 30. In an analogous manner, the fourth branch consists of a capacitance $C_4$ (corresponding to the second major cavity of FIG. 4) in series with a resistance $R_4$ and an inductance $L_4$ representing the parameters of channel 40. The fifth branch is a series combination of a capacitance $C_5$ (representing the intermediate cavity of FIG. 4) in series with an inductance $L_5$ and a resistance $R_5$ (the parameters of channel 50) as well as a further resistance $R_5'$ representing the port 51. The sixth branch is an impedance $Z_6$ in series with a resistance $R_6'$, the latter representing the port 61 of FIG. 4; impedance $Z_6$ is that of cavity $C_6$ and is illustrated in greater detail in FIG. 6 as a transmission line symbolized by a series of filter networks each consisting of a shunt capacitance $C_6'$, a series inductance $L_6$ and a series resistance $R_6$. It will be understood that the impedances of FIG. 6 are distributed throughout the cylindrical cavity $C_6$ of FIG. 4.

In a preferred embodiment, cavity $C_6$ has a diameter between about 7.5 and 8 mm and an axial height between about 11 and 12 mm. Channel 50 has about the same diameter but is of substantially shorter axial length.

We claim:

1. A phonometric device for telephone equipment, designed to approximate the acoustic impedance of a human ear held close to a telephone receiver, comprising:

a generally disk-shaped body with an annular ridge encompassing a substantially frustoconical, outwardly diverging recess, said body being provided with a plurality of internal cavities communicating with said recess and including at least one major cavity resonant at a low audio frequency, an intermediate cavity resonant in the middle audio range and a minor cavity resonant at a high audio frequency, said minor cavity being elongate and opening onto said recess near the bottom thereof; and a microphone in said recess for converting incoming sound waves into electrical signals.

2. A phonometric device as defined in claim 1 wherein said microphone has a pick-up head disposed substantially at the level of the crest of said ridge, said recess having a depth of about 1 cm.

3. A phonometric device as defined in claim 1 wherein said cavities communicate with said recess through restricted channels of acoustically resistive and inductive character.

4. A phonometric device as defined in claim 3, further comprising a first acoustic resistance inserted between said intermediate cavity and said recess, and a second acoustic resistance inserted between said minor cavity and said recess.

5. A phonometric device as defined in claim 4 wherein said internal cavities further include another major cavity resonant at a low audio frequency and communicating with said recess through a restricted channel of acoustically resistive and inductive character.

6. A phonometric device as defined in claim 5 wherein one of said major cavities is essentially a first acoustic capacitance of at least 12 μF, the other of said major cavities being essentially a second acoustic capacitance of at least 9 μF, said intermediate cavity being essentially a third acoustic capacitance of at least 0.5 μF.

7. A phonometric device as defined in claim 6 wherein said first, second and third acoustic capacitances have maximum values of substantially 15 μF, 12 μF and 0.6 μF, respectively.

8. A phonometric device as defined in claim 1 wherein said minor cavity has a volume which is smaller than that of said major cavity by about one order of magnitude.

9. A phonometric device as defined in claim 8 wherein said minor cavity is cylindrical with a diameter between substantially 7.5 and 8 mm and with a length between substantially 11 and 12 mm.

10. A phonometric device as defined in claim 9 wherein said minor cavity extends substantially along the axis of said recess.

* * * * *